US006322395B1

(12) United States Patent
Nishio et al.

(10) Patent No.: US 6,322,395 B1
(45) Date of Patent: Nov. 27, 2001

(54) ELECTRICAL CONNECTOR

(75) Inventors: Atsushi Nishio, Ibaraki; Katsuhiro Hori, Mito, both of (JP)

(73) Assignee: Mitsumi Newtech Co., Ltd. (JP)

( * ) Notice: Subject to any disclaimer, the term of this patent is extended or adjusted under 35 U.S.C. 154(b) by 0 days.

(21) Appl. No.: 09/491,471

(22) Filed: Jan. 26, 2000

(30) Foreign Application Priority Data

Jan. 27, 1999 (JP) ..... 11-018583

(51) Int. Cl.[7] ..... H01R 13/648
(52) U.S. Cl. ..... 439/607; 439/79
(58) Field of Search ..... 439/607, 610, 439/79

(56) References Cited

U.S. PATENT DOCUMENTS 5,718,605 * 2/1998 Morikawa et al. ..... 439/607
5,755,595 * 5/1998 Davis et al. ..... 439/607
5,919,062 * 7/1999 Wu ..... 439/607
6,095,837 * 8/2000 David et al. ..... 439/607
6,132,254 * 10/2000 Wu ..... 439/607
6,165,015 * 12/2000 Wu et al. ..... 439/607

* cited by examiner

*Primary Examiner*—Hien Vu
(74) *Attorney, Agent, or Firm*—Morrison Law Firm

(57) ABSTRACT

Mutually engaging interlocking elements disposed on abutting left and right bottom walls of a shield case interlock to resist metal spring back. The shield cases are formed by bending sheet metal into rectangular shaped columns. The shield cases surround the plug and socket in a miniature electrical connector. The socket has fixing wings and fixing legs which are soldered to a printed circuit board. The plug is removably inserted within the socket.

4 Claims, 4 Drawing Sheets

ELECTRICAL CONNECTOR

BACKGROUND OF THE INVENTION

The present invention relates to an electrical connector. More specifically, the present invention relates to a miniature electrical connector used for connecting electronic devices such as personal computers.

Recently, personal computers have begun to use miniature connectors referred to as USB (Universal Serial Bus) connectors.

Referring to FIG. 5, a miniature electrical connector, typically includes: a connector socket 2A mounted on a printed circuit substrate 1A. A connector plug 3A, is insertable within connector socket 2A. Connector socket 2A includes a shield case 4A, which is formed by bending a metal sheet in the shape of a rectangular column.

An insulative housing 6A, disposed within shield case 4A, supports four contact pins SA. Contact pins 5A are laterally arranged side-by-side. An intermediate section of contact pins 5A is fixed to an insulative housing base 6*a*. This arrangement connects external connecting ends 5*a* to contact pins 5A. An end support 6*b* is integrally molded with the upper half of insulative housing base 6*a*. End support 6*b* is formed so that its vertical thickness is roughly half that of shield case 4A. A bottom wall of end support 6b supports a contact end 5*b* of contact pins 5A.

Connector plug 3A connects to connector socket 2A. A shield case 7A, which is formed as a rectangular column, can be inserted inside shield case 4A. A space 8A is formed within a plug shield 7*a* of shield case 7A and receives end support 6*b*. A contactor 10 has a contact end 10*a* positioned directly below space 8A. Contact end 10*a* is supported by an end support 9*a* of an insulative housing 9A.

Shield cases 4A and 7A are formed by bending sheets of metal at right angles to form a rectangle. The bottom walls abut against each other to close the rectangle. However, due to "springing back" inherent in the bending) process, the left and right surfaces tend to open resulting in lowered production yields.

This springing back tendency is an obstacle to reducing the size of connector socket 2A and connector plug 3A. It is more difficult to process the shield cases 4A and 7A as their size is reduced.

OBJECTS AND SUMMARY OF THE INVENTION

An object of the present invention is to overcome the problems of the conventional miniature connector described above.

Another object of the present invention is to provide a structure that allows precise processing of shield cases into their requisite rectangular shapes.

Briefly stated, the present invention provides mutually engaging interlocking elements disposed on abutting left and right bottom walls of a shield case interlock to resist metal spring back. The shield cases arc formed by bending sheet metal into rectangular shaped columns. The shield cases surround the plug and socket in a miniature electrical connector. The socket has fixing wings and fixing legs which are soldered to a printed circuit board. The plug is removably inserted within the socket.

According to an embodiment of the invention, there is provided an electrical connector comprising: a shield case; the shield case being a sheet metal; a first end of the sheet metal being bent to form a first portion of a bottom wall; at least a first interlocking element disposed on an end of the first portion; a second end of the sheet metal being bent to form a second portion of the bottom wall; at least a second interlocking element disposed on an end of the second portion; and the first and second portions being bent to interengage whereby the first and second interlocking elements interlock to prevent the bottom wall from opening due to spring back.

According to another embodiment of the invention, there is provided an electrical connector comprising: a plug shield case; the plug shield case being a sheet metal; a first end of the sheet metal being bent to form a first portion of a bottom wall; at least a first interlocking element disposed on an end of the first portion; a second end of the sheet metal being bent to form a second portion of the bottom wall; at least a second interlocking element disposed on an end of the second portion; and the first and second portions being bent to interengage whereby the first and second interlocking elements interlock to prevent the bottom wall from opening due to spring back.

According to yet another embodiment of the invention, there is provided an electrical connector comprising: a shield case; the shield case being a sheet metal; a first end of the sheet metal being bent to form a first portion of a bottom wall; at least a first interlocking element disposed on an end of the first portion; a second end of the sheet metal being bent to form a second portion of the bottom wall; at least a second interlocking element disposed on an end of the second portion; the first and second portions being bent to interengage whereby the first and second interlocking elements interlock to prevent the bottom wall from opening due to spring back; a plug shield case; the plug shield case being a sheet metal; a first end of the sheet metal being bent to form a first portion of a bottom wall; at least a first interlocking element disposed on an end of the first portion; a second end of the sheet metal being bent to form a second portion of the bottom wall; at least a second interlocking element disposed on an end of the second portion; the first and second portions being bent to interengage whereby the first and second interlocking elements interlock to prevent the bottom wall from opening due to spring back; and the plug shield case being removably fittable within the shield case.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
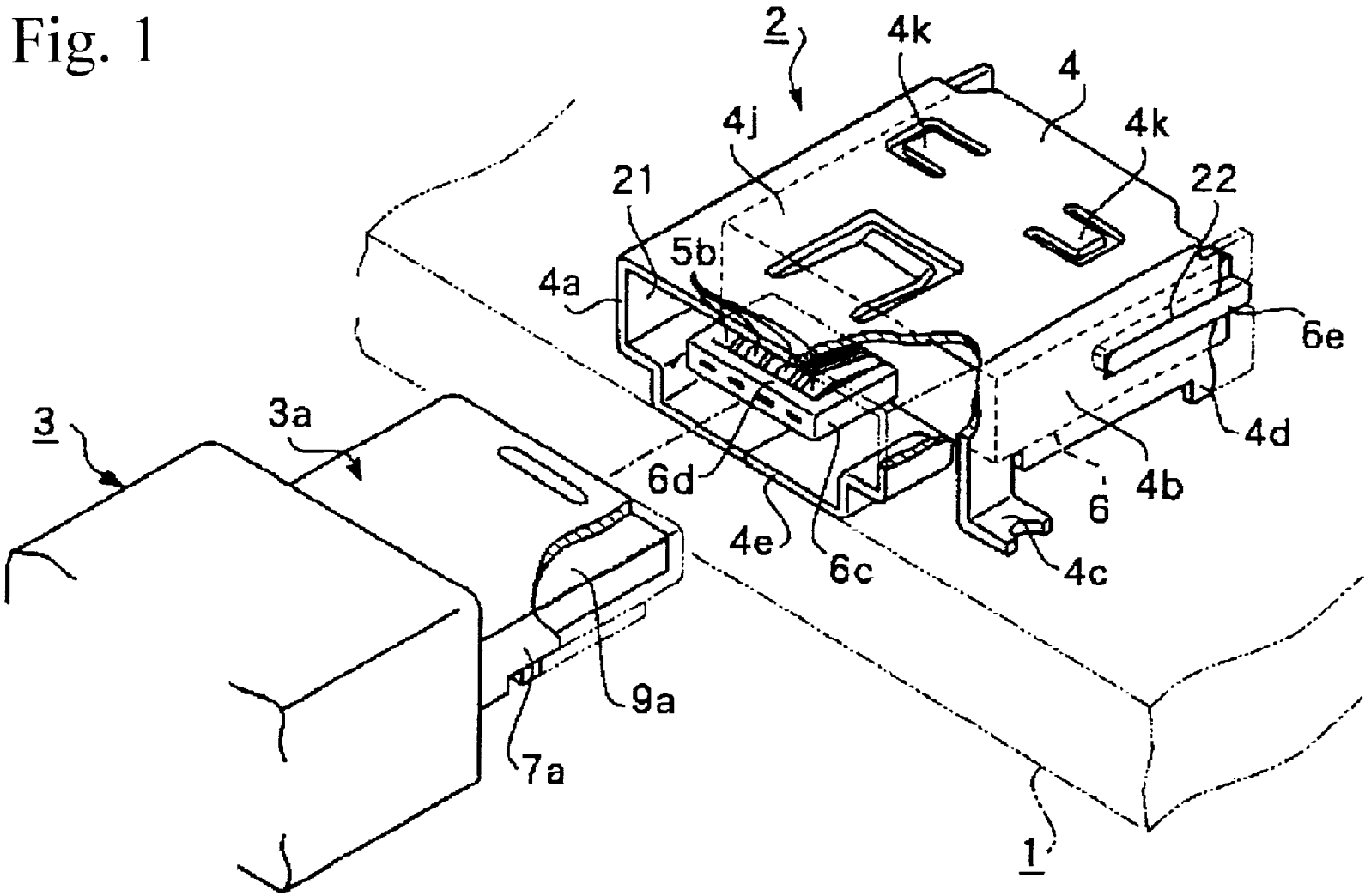
FIG. 1 is an exploded perspective drawing of an electrical connector according to the present invention with a section cut away.
Figure 2:
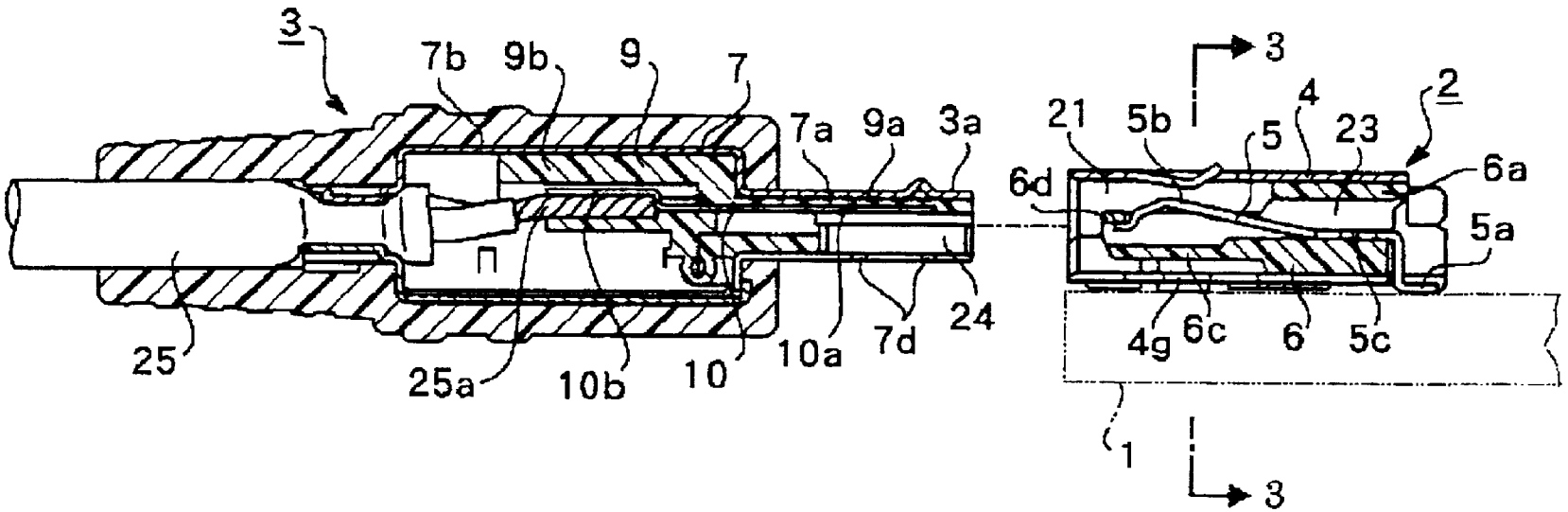
FIG. 2 is a longitudinal cross-section drawing of the miniature connector.

Referring to FIGS. 1 and 2, a miniature electrical connector includes a connector socket 2. Connector socket 2 is mounted on a surface of a printed circuit substrate 1. A connector plug 3 has a plug 3*a* that can be inserted into an insertion opening 21 of connector socket 2.

Connector socket 2 includes a shield case 4. Shield case 4 is formed by bending a sheet of metal into a rectangular cylinder so that an end defines insertion opening 21.

Figure 3:
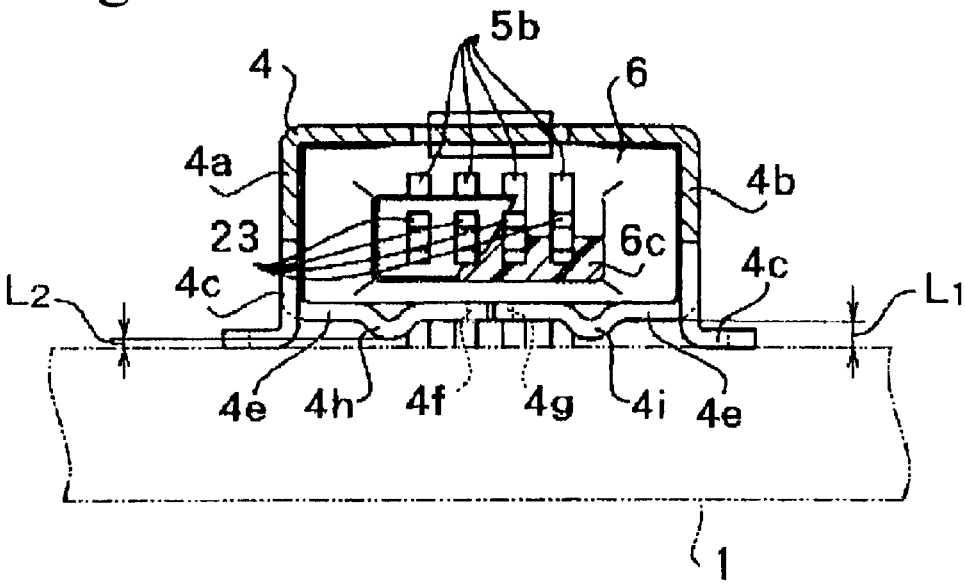
FIG. 3 is a cross-section detail drawing along the 3—3 line of the miniature connector in FIG. 2.

Referring now to FIGS. 1 and 3, a pair of fixing wings 4*c* are formed at the bottom edges of a left side wall 4*a* and right side wall 4*b* of shield case 4, respectively. Each Fixing wing 4*c* is bent to form an L-shaped structure with the foot of L-shaped fixing wing 4*c* facing printed circuit substrate 1. A pair of fixing legs 4*d* are formed by cutting rear sections of shield case 4 so that a left and right leg 4*d* projects downward towards printed circuit substrate 1.

Referring to FIG. 3, the bottom wall of shield case 4 is separated from the surface of printed circuit substrate 1 by a gap L1. Fixing wings 4*c* and fixing legs 4*d* extend past a bottom wall 4*c* of shield case 4 and rest on the surface of printed circuit substrate 1 ensuring that gap Ll is maintained. In this way, when connector socket 2 is mounted on printed circuit substrate 1, bottom wall 4*e* is prevented from making contact with printed circuit substrate 1. Only the bottom surfaces of fixing wings 4*c* and fixing legs 4*d* are in contact with the conductor layer of printed circuit substrate 1. Fixing wings 4*c* and fixing legs 4*d* are fixed to printed circuit substrate 1 using solder dipping. This ensures that connector socket 2 is firmly attached to printed circuit substrate 1. Thus, the flux from the soldering operation can be easily let out through gap L1 formed between printed circuit substrate 1 and bottom wall 4*e*.

Figure 4:
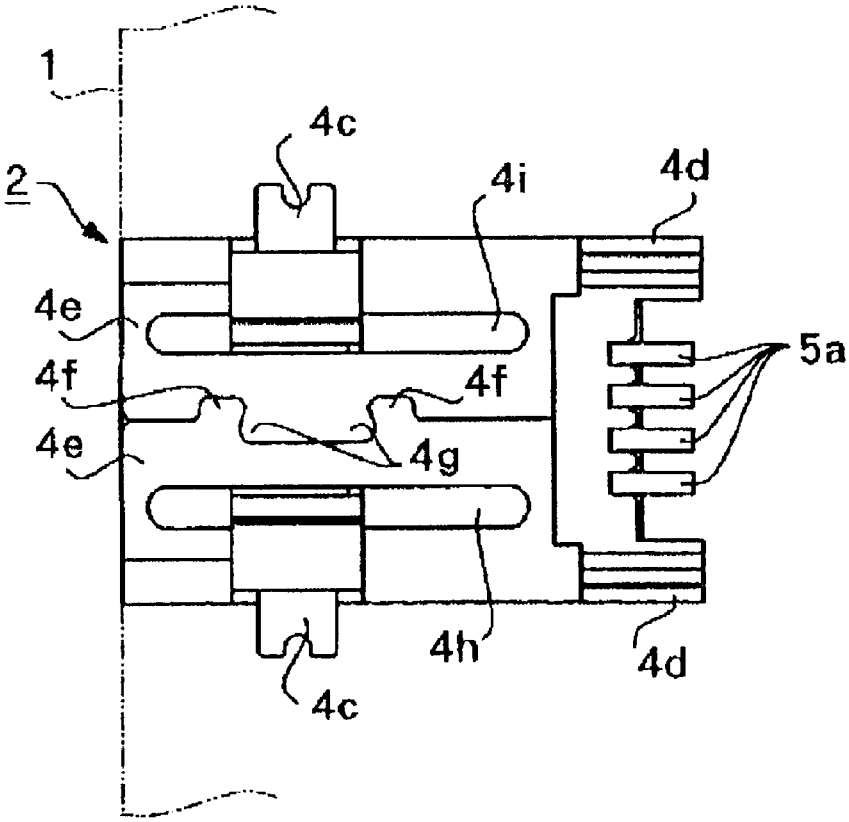
FIG. 4 is a bottom-view detail drawing of a connector socket from the miniature connector.
Figure 5:
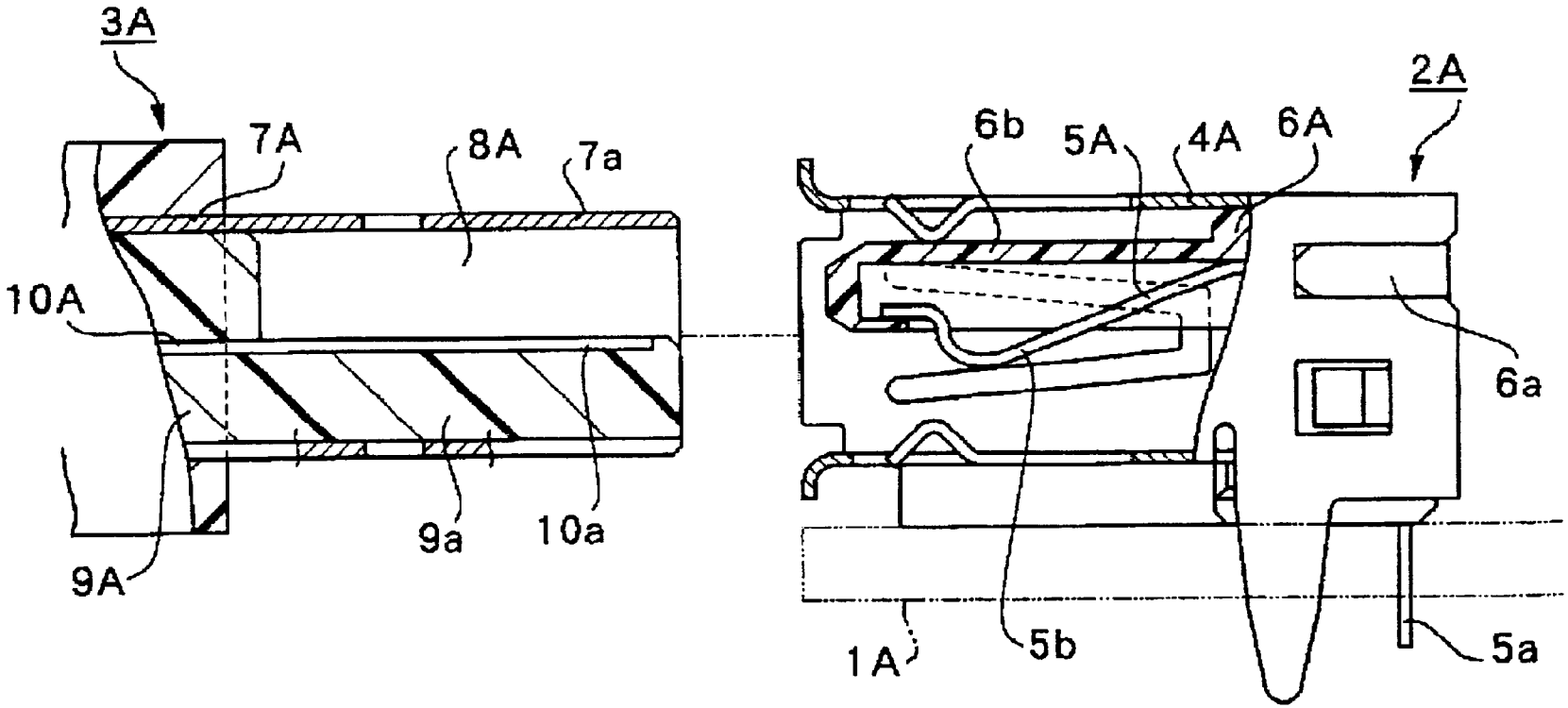
FIG. 5 is a side-view detail drawing of a conventional USB connector with one section cut away.

Referring to FIG. 4, bottom wall 4*e* of shield case 4 is formed by perpendicularly bending left and right side walls 4*a* and 4*b* respectively, until their end surfaces abut each other. Two mutually engaging interlocking claw-shaped elements 4*f* and 4*g* are disposed along the ends of left and right side walls 4*a* and 4*b*. Interlocking elements 4*f* and 4*g* interlock with each other aligning and holding shield case 4 firmly in shape against the tendency of the material to spring back after bending.

Two bridge projections, 4*h* and 4*i*, are formed along bottom wall 4*e*. Bridge projections 4*h* and 4*i* project downward toward printed circuit substrate 1. Bridge projections 4*h* and 4*i* prevent bottom wall 4*e* from opening even when stressed due to improper insertion or removal of connector plug 3.

Referring again to FIGS. 1 and 2, an insulative housing 6, molded from resin, is positioned inside shield case 4. Insulative housing 6 supports four contact pins 5. Contact pins 5 are arranged in a row along the lateral axis of shield case 4.

Insulative housing 6 fits within shield case 4. In order to facilitate and ensure precise positioning of insulative housing 6, shield case 4 has two slots 22. Slots 22 are formed along a rear portion left wall 4*a* and right wall 4*b*. Ridge projections 6*e* are integrally formed in insulative housing 6. Projections 6*e* fit within slots 22. This arrangement guides insulative housing 6 as it is inserted within shield case 4. Because of the interlocking nature of slots 22 and projections 6*e*, insulative housing 6 is aligned and stabilized when inserted into shield case 4.

Insulative housing 6 is inserted into shield case 4 from the rear. Ridge projections 6*e* of insulative housing 6 fit into slots 22. This arrangement vertically stabilizes insulative housing 6 relative to shield case 4. Also, housing 6 is prevented from moving, forward relative to shield case 4, thereby securing the forward positioning of insulative housing 6.

Insulative housing 6 includes a base 6*a*. Base 6*a* has a cross-sectional dimension that is roughly the same as the cross-sectional dimension of the inside of shield case 4. Two cavities (not shown) are formed on an upper surface of base 6*a*. Two fixing claws 4*k* are formed by cutting and bending an upper wall 4*j* of shield case 4. Fixing claws 4*k* fit into the two cavities (not shown.) Thus, when insulative housing 6 is inserted into shield case 4 during assembly, fixing claws 4*k* are inserted into the corresponding cavities. This positions insulative housing 6 relative to shield case 4 and fixes same.

An end support 6*c* is formed integrally with base 6*a* as a cantilevered projection within shield case 4. Four attachment (grooves 23 are formed along the length of end support 6*c* and base 6*a*. Attachment grooves 23 are arranged parallel to each other along the lateral axis of shield case 4. Elastic metal contact pins 5 are positioned in each attachment groove 23. An intermediate section of contact pins 5 is fixed within corresponding attachment grooves 23. External connection ends 5*a*, formed as L-shaped bends in contact pins 5, extend out from the rear of shield case 4. External connection ends 5*a* are soldered to the conductor layer of printed circuit substrate 1.

Contact ends 5*b* are formed as arcuate bends in contact pins 5. Contact ends 5*b* are exposed upwardly from within attachment grooves 23 to an upper surface of end support 6*c*. Contact ends 5*b* are held by engagement pieces 6*d*. Engagement pieces 6*d* are formed integrally with an end of end support 6*c*. Engagement pieces 6*d* prevent external connection ends 5*a* from freely projecting outside corresponding attachment grooves 23.

Referring to FIGS. 2 and 3, connector plug 3 is covered with an outer insulative resin covering. Plug 3*a* and a shield case 7 are also covered with an insulative resin. Plug 3*a* includes a plug shield 7*a*. Plug shield 7*a* has an outer dimension that corresponds to the inner dimension of shield case 4. Plug 3*a* fits within insertion opening 21. As with shield case 4 described above, plug shield 7*a* is formed by bending a sheet of metal into a rectangular column. All end support 9*a* of an insulative housing 9 is positioned inside plug shield 7*a*. End support 9*a* supports four contactors 10. Contactors 10 and contact pins 5 are aligned with each other.

Contact ends 10*a* of contactors 10 are exposed at a bottom wall of end support 9*a*. Contact ends 10*a* extend along an upper wall of plug shield 7*a*. A space 24 is bounded by end support 9*a* and plug shield 7*a*. Space 24 receives end support 6*c* of insulative housing 6 described above. Thus, when plug 3*a* of connector plug 3 is fitted into insertion opening 21, end support 6*c* and end support 9*a* are brought close together. End support 6*c* is positioned just below end support 9*a* facing each other. As a result, contact ends 10*a* of contactors 10 come into contact with corresponding contact ends 5*b* of contact pins 5.

Shield case 7, described above, includes a cord shield 7*b*. Cord shield 7*b* is formed integrally with plug shield 7*a*. Cord shield 7*b* is formed to enclose a comparatively large volume. A cord connector 9*b*, which is connected to end support 9*a*, is positioned inside cord shield 7*b*. Cord connection ends 10*b* of contactors 10 are positioned within cord connector 9*b*. Cord connection ends 10*b* are fixed via solder to wires 25*a* in a connection cord 25. Connection cord 25 feeds in from an end of cord shield 7*b*.

Referring again to FIGS. 1 and 2, assembled connector socket 2 is mounted on the surface of printed circuit substrate 1. Shield case 4 is formed using a sheet metal blank. The sheet metal blank is bent at right angles. However, due to the spring-back effect of metal inherent in the bending process, a bottom wall 4*e* of shield case 4 will tend to open outward when the two ends are abutted against each other. This is why the abutting surfaces of bottom wall 4*e* of shield case 4 are formed with mutually engaging claw elements 4*f* and 4*g*. Claw elements 4*f* and 4*g* engage each other and reliably prevent bottom wall 4*e* from opening.

A bottom wall 7*c* is formed with claw elements 7*d* analogous with claw elements 4*f* and 4*g* (FIG. 4) described above. This prevents the abutting left and right bottom walls 7*c* from opening.

As insulative housing 6, to which contact pins 5 are attached, is inserted into shield case 4, it is guided and supported by ridge projections 6*e*. Insulative housing 6 is firmly fixed to shield case 4 due to the interaction of slots 22 with ridge projections 6*e*. Fixing claws 4*k* engage insulative housing 6 and prevent insulative housing 6 from disengaging from shield case 4.

Connector socket 2 is soldered to printed circuit substrate 1 using solder dipping. Fixing) wings 4*c* and fixing legs 4*d* of shield case 4 are soldered to the conductor layer of printed circuit substrate 1. Thus, even if a large external force is applied to connector socket 2 during insertion or removal of connector plug 3, connector socket 2 remains firmly fixed to printed circuit substrate 1. Fixing legs 4*d* firmly hold external connection ends 5*a* of contact pins 5 against the conductor layer of printed circuit substrate 1.

If shield case 4 is "forced" by an external force during insertion or removal of connector plug 3, bottom wall 4*e* of shield case 4 will tend to open. If this happens, the bottom surfaces of projections 4*h* and 4*i* will come into contact with the surface of printed circuit substrate 1. Once this happens, any further opening is prevented. This prevents bottom wall 4*e* from being forced open and coming into contact with the conductor layer of printed circuit substrate 1.

As the description above makes clear, interlocking claw-shaped elements 4*f*, 4*g* and 7*d* disposed on bottom walls 4*e* and 7*c* respectively, allow bottom walls 4*e* and 7*c* to be precisely aligned while minimizing spring back. The resulting connector can be made very small.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrical connector comprising:

a shield case;

said shield case being a sheet metal;

a first end of said sheet metal being bent to form a first portion of a bottom wall;

at least a first interlocking element disposed on an end of said first portion;

a second end of said sheet metal being bent to form a second portion of said bottom wall;

a downwardly extending left and right fixing wing disposed along a front portion of a left and right side surface respectively of said shield case;

said fixing wings are L-shaped having a foot part;

said foot part extendable downward for mounting on a circuit board;

a downwardly extending left and right fixing leg disposed along a rear portion of a left and right side surface respectively of said shield case toward said circuit board;

said fixing legs being positioned to contact said circuit board for stabilizing said electrical connector;

at least one downwardly extending bridge projection disposed along a bottom surface of said bottom wall in a direction substantially parallel to a mating direction for abutting with a surface of said circuit board;

at least a second interlocking element disposed on an end of said second portion; and said first and second portion being bent to interengage whereby said first and second interlocking elements interlock to prevent said bottom wall from opening due to spring back.

2. An electrical connector according to claim 1, wherein said fixing wings and said fixing legs project beyond a bottom surface of said shield case.

3. An electrical connector comprising:

a shield case;

said shield case being a sheet metal;

a first end of said sheet metal being bent to form a first portion of a bottom wall;

at least one downwardly extending bridge projection disposed along a bottom surface of said bottom wall in a direction substantially parallel to a mating direction for abutting with a surface of a printed circuit board;

at least a first interlocking element disposed on an end of said first portion;

a second end of said sheet metal being bent to form a second portion of said bottom wall;

at least a second interlocking element disposed on an end of said second portion;

said first and second portions being bent to interengage whereby said first and second interlocking elements interlock to prevent said bottom wall from opening due to spring back;

a plug shield case;

said plug shield case being a sheet metal;

a first end of said sheet metal being bent to form a first portion of a bottom wall;

at least a first interlocking element disposed on an end of said first portion;

a second end of said sheet metal being bent to form a second portion of said bottom wall;

at least a second interlocking element disposed on an end of said second portion;

said first and second portions being bent to interengage whereby said first and second interlocking elements interlock to prevent said bottom wall from opening due to spring back; and said plug shield case being removably fittable within said shield case.

4. An electrical connector according to claim 2, wherein:

said shield case having a downwardly extending left and right fixing wing disposed along a front portion of a left and right side surface respectively of said shield case;

said fixing wings are L-shaped having a foot part;

said foot part extending downward for mounting on a circuit board;

said shield case also having a downwardly extending left and right fixing leg disposed along a rear portion of a left and right side surface respectively of said shield case toward said circuit board; and said left and right fixing legs being positioned to contact said circuit board for stabilizing said electrical connector.

* * * * *